United States Patent [19]

Ibach

[11] 4,309,607

[45] Jan. 5, 1982

[54] ELECTRON-IMPACT SPECTROMETER

[75] Inventor: Harald Ibach, Aachen-Verlautenheide, Fed. Rep. of Germany

[73] Assignee: Kernforschungsanlage Jülich Gesellschaft mit beschränkter Haftung, Jülich, Fed. Rep. of Germany

[21] Appl. No.: 96,618

[22] Filed: Nov. 23, 1979

[30] Foreign Application Priority Data

Nov. 30, 1978 [DE] Fed. Rep. of Germany ..... 2851743

[51] Int. Cl.[3] ..... H01J 40/00

[52] U.S. Cl. ..... 250/305; 250/310; 250/396 R

[58] Field of Search ..... 250/305, 310, 396 R

[56] References Cited

U.S. PATENT DOCUMENTS 3,699,331 10/1972 Palmberg ..... 250/305

3,742,214 6/1973 Helmer et al. ..... 250/305

3,786,268 1/1974 Nomura ..... 250/310

*Primary Examiner*—Harold A. Dixon

*Attorney, Agent, or Firm*—Frishauf, Holtz, Goodman & Woodward

[57] ABSTRACT

The radiant heat of the graphite carrier of a $LaB_6$ cathode is utilized to heat the input diaphragm of the monochromator of an electron spectrometer by opening up the aperture in the repeller electrode that provides magnetic shielding from the heating current and through which the emitting portion of the cathode projects, so that the entire surface of the graphite carrier can radiate heat towards the input diaphragm. The spacing of the point of the cathode from the graphite carrier may be increased in order to accord with the provision of additional heat in the carrier for radiation to the diaphragm. The radiant heat raises the temperature of the diaphragm and thereby reduces electrostatic charges resulting from bombardment of the diaphragm by electrons from the cathode, allowing a larger beam current to be monochromatized.

5 Claims, 4 Drawing Figures

ELECTRON-IMPACT SPECTROMETER

Figure 1:
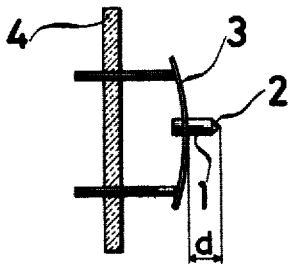

This invention concerns an electron-impact spectrometer for observing and measuring the energy distribution of electrons scattered from the surface of a target sample which is bombarded with electrons having substantially the same energy. In analogy to the selection of photons of a narrow energy range by means of monochromators the filtering of a beam of electrons so as to select only electrons having an energy within a very narrow range is referred to as monochromatization, and such a beam is described as monochromatic.

An electron-impact spectrometer of the kind in which the improvement of the present invention is applicable comprises, in an evacuated vessel, an electron emitting cathode arranged to produce a beam of electrons focussed upon the input slit of a monochromator, means for shielding the magnetic field of the heating current of the cathode from the electron beam, an electron lens system for concentrating the electron beam on the target sample and an energy analyzer for the electrons reflected from the target sample. Such electron spectrometers are used for the analysis of gases and of the surfaces of solids, obtaining relevant information in the form of characteristic energy losses of the electrons upon reflection. In recent times, the application of electron-impact spectrometers has extended to the investigation of vibration spectra of adsorbed substances, as the result of which use of such instruments in catalysis research has become of particular interest.

A typical electron-impact spectrometer configuration (see FIG. 3) comprises a cathode, from which emitted electrons are focussed upon the input slit of a capacitor having a cylindrical gap and serving to produce dispersion of the electrons according to their energy, hence operating as a monochromator. The electrons are then focussed upon the target, which may be a sample of a material to be investigated, where they are reflected, after which the electrons are analyzed with respect to their energy in a device similar to the monochromator.

Space charge effects in the monochromator basically limit the amount of current in the electron beam focussed on the target. Theoretical estimates taking account of the focussing or "image" errors caused by space charge lead to values of current that are about five times as much as what is obtained in practice with the equipment heretofore available. For example, only about 20% of the theoretically obtainable current is obtained in a conventional electron-impact spectrometer of the kind above referred to, in which the elongated slit utilized in the input diaphragm of the monochromator has a height (length) of about 4 mm. The use of spherical capacitors as energy-dispersive elements, equipped with circular input slits, has been tried, but the values of current obtained in fact were then even lower (by up to 2 orders of magnitude). The cause of these shortcomings has for a long time been unknown.

It is an object of the present invention to provide an electron-impact spectrometer which provides substantially more monochromatic electron beam current than has been available, and more particularly, as much electron current as can be provided in an instrument having the highest possible absolute resolution.

SUMMARY OF THE INVENTION

It has been found that a substantial improvement in electron-impact spectrometers can be obtained by reducing the charge on the input slit by raising the temperature of the diaphragm that defines the slit. In order that the input diaphragm of the monochromator may benefit from this discovery without sacrifice of resolution from the result of the magnetic field of an electric heating current, the input diaphragm is indirectly heated by radiant heat from an electrically heated heat source located so that its heating current and the magnetic field thereof have no substantial influence on the electron beam passing through the slit of the diaphragm. Such an indirect heating of the diaphragm could be obtained by any supplementary magnetically shielded heating arrangement placed in the vicinity or on the diaphragm serving as the entrance slit of the monochromator. A bifilar wrapped wire for electric heating encapsulated in μ-metal and soldered to the diaphragm serving as input slit e.g. would render the same service. Most conveniently, however, the indirect heating is accomplished by using the cathode device itself, which has a heater already magnetically shielded from the diaphragm as the heat source, and for this purpose it is generally desirable to supply a greater heating current to the cathode than is needed merely for its normal function of producing the necessary electron emission. The cathode and cathode heating arrangements should be selected according to this purpose, a most simple and effective arrangement being shown and described later on.

Experiments have shown that bomardment of a metal surface with electrons charges up the metal surface itself under conditions of ultra-high vacuum. In consequence, the potential of the metal electrodes used in the electron spectrometer, which actually determines the paths of the electrons in the electron beam, is reduced by a few tenths eV, compared to the externally applied potential. It is to be expected that this effect would be particularly noticeable at the input diaphragm of the monochromator, since the full cathode current, except what passes through the slit, impinges upon this diaphragm. In order to obtain a high resolution, the energy-dispersive elements must be operated at electron pass energies of the order of 1 eV. A reduction of the effective potential in the input slit by a few tenths eV accordingly has substantial influence on the space charge arising in the neighborhood of the input slit and, therefore, finally, on the amount of monochromatic beam current available.

It has been found that the simplest and most effective method for preventing such charging-up of the diaphragm is to raise its temperature. As already mentioned, the means for obtaining such a temperature rise are subject to serious limitations: the provision of a simple supplementary electrical heater on the diaphragm itself without magnetic shielding is out of the question, since the magnetic fields related to the heating current would make impossible the proper operation of the spectrometer. According to the invention, therefore, the heating is produced indirectly, particularly by using the joulean heat used for heating the cathode as a source of radiant heat for heating the input diaphragm. That means that the heating power and heat radiation geometry of any kind of cathode used to produce electron emission is selected in such a way that the thermal radiation towards the input diaphragm is raised, while nevertheless at the same time care is taken to assure that the magnetic fields produced by the cathode heating current are without influence on the electron beam current or, as usual, are confined by shielding (for example by the use of a $\mu$-metal shield).

In a special embodiment of the invention, an effective increase of the temperature of the input slit can be obtained in instruments utilizing the known $LaB_6$ cathodes equipped with a graphite carrier by observing the following significant relations:

(1) the spacing between the cathode point and the carrier is made greater than the usual about 1 mm and therefore, the heat dissipated in the cathode system is raised, and (2) assurance that the highest possible proportion of the radiated heat reaches the input diaphragm is provided by opening up the aperture in the repeller that serves also as a magnetic shield, so that the radiation of the cathode carrier (especially graphite carrier) effectively reaches the input diaphragm. One possibility is to make the opening of the repeller about as long and as wide as the graphite carrier of the cathode and, preferably, so that the slit type aperture thus provided extends completely across the repeller, dividing it into two, the slit thus formed being aligned both with the graphite carrier of the cathode and the slit of the input diaphragm of the monochromator.

Figure 2A:
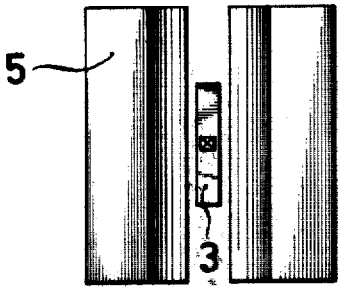
Figure 2B:
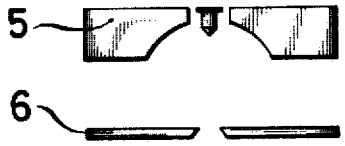
Figure 3:
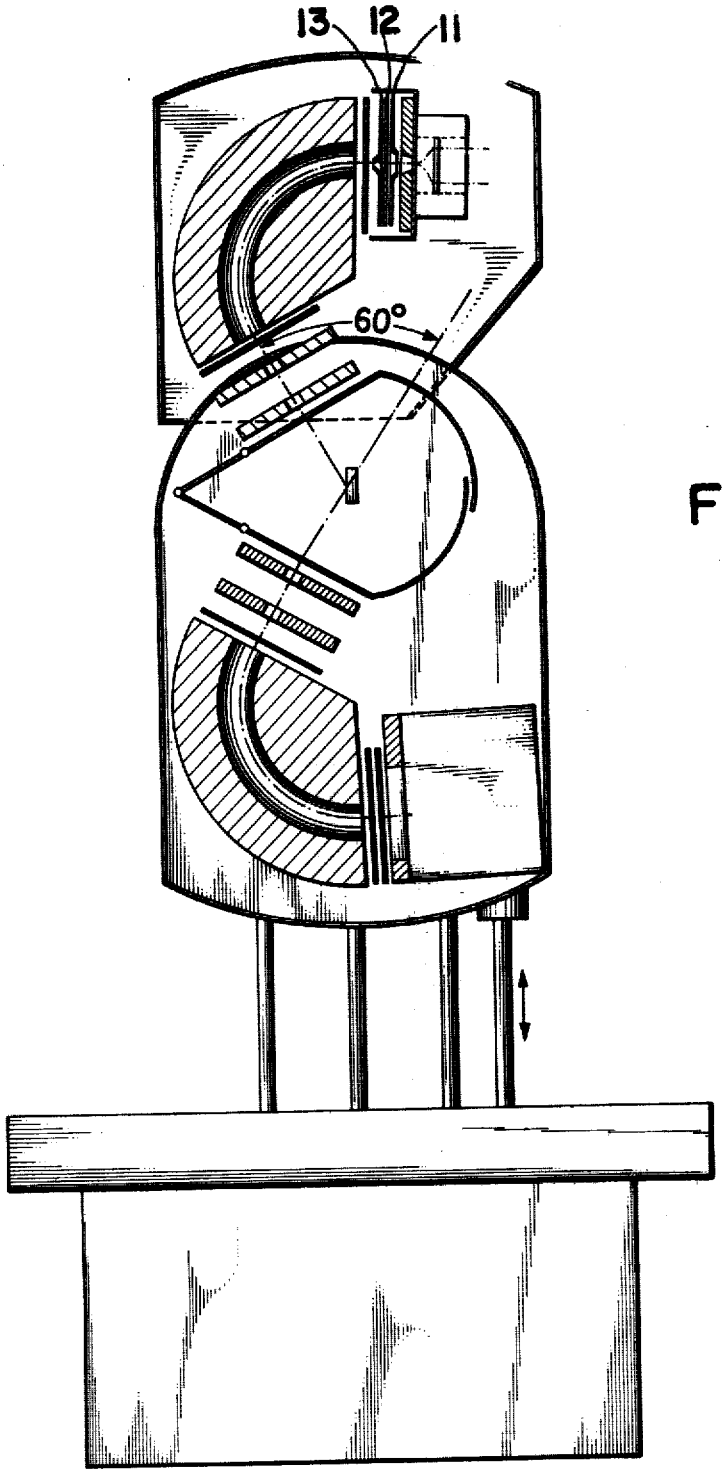

Theinvention is further described with reference to an illustrative example, with reference to the annexed drawings, in which:

FIG. 1 is a diagram, in side view, of a cathode of an electron impact spectrometer;

FIG. 2*a* shows in plan view, looking towards the emissive surface of the cathode, an assembly of cathode and repeller in an electron-impact spectrometer according to the present invention;

FIG. 2*b* is a diagrammatic side view of the assembly of FIG. 2*a* as further assembled in operating position with respect to the input diaphragm of the monochromator of the electron-impact spectrometer, and FIG. 3 is a diagram, representing a top view, of an electron spectrometer of the kind in which the cathode, repeller and input diaphragm shown in FIG. 2*b* may be used.

Lanthanum boride cathodes of the kind shown in FIG. 1 can be used in electron spectrometers in order to obtain high emissivity. These usually consist of a $LaB_6$ rod 1 that tapers to a fine point 2 and is mounted at its other end on a graphite carrier 3 that in turn is supported on a ceramic holder 4. The graphite carrier is heated by the passage of current through it. The spacing d between the point of the $LaB_6$ rod and the graphite carrier has heretofore been chosen to be about 1 mm. If this spacing is increased, it is then necessary to provide a substantially higher power level of heat dissipation in the graphite carrier in order to obtain the same electron beam current. By increasing the spacing to about 2 mm, the necessary heat dissipation rises to about 10 watts.

In electron spectrometers heretofore known, the repeller adapted to the cathode and also serving to provide magnetic shielding, had a more or less circular hole of a diameter of 2–3 mm cut in it, through which the cathode point was inserted. With such an arrangement, the radiant heat of the graphite carrier thus remained in the space behind the repeller. By cutting the repeller 5 (as shown in FIG. 2) all the way across, in its entire vertical length in the direction of the input slit of the spectrometer), or if not fully across the repeller, then at least over a length corresponding to the length of the graphite carrier 3, the heat dissipation of the graphite carrier can be effectively utilized for heating the input slit 6 shown in FIG. 2*b*. Focussing elements having much larger aperture and potential than the diaphragm, such as the elements 11, 12 and 13 of FIG. 3, may be inserted between the input slit 6 shown in FIG. 2*b* and the repeller 5, any charging of these elements being negligible. Disadvantageous effects on the electric field lines are thereby hardly to be expected, since the field lines in the neighborhood of the cathode point 2 are only slightly influenced by such an opening in the repeller 5.

Experiments with the configuration just described have shown that with reference to an operating resolution of 6 meV, the current can in fact be raised from $1\times10^{-10}$ A to $6\times10^{-10}$ A, thus by a factor of 6. This increase signifies in measurement operations a shortening of the measuring time by the same factor, or else an increase of the signal to noise ratio by the factor of 2.5 for the same measuring time.

Although the invention has been described with reference to a particular illustrative embodiment, it will be understood that modifications and variations are possible within the inventive concept.

I claim:

1. Apparatus for producing a high-current high-resolution electron beam comprising an electron source in the form of a cathode equipped with an electrical heater and magnetic shielding for shielding electrodes downstream of the electron source from the magnetic field of said electrical heater, and electron-optical beam treatment means having an input diaphragm facing said electron source, said apparatus comprising the improvement which consists in that:

said input diaphragm is indirectly heated to a substantial degree by said electrical heating means of said cathode, which is supplied with more current than is normally needed for producing the necessary electron emission for said electron-impact spectrometer, thereby increasing the amount of heat radiated away from said cathode device;

said cathode comprises a pointed body of $LaB_6$ (1,2) carried on and heated by a graphite carrier (3) and having its pointed end spaced from said carrier by substantially more than 1 mm, and said shielding means includes a repeller (5) spaced from said $LaB_6$ body and having a slit running in a direction parallel to the long dimension of said carrier and also parallel to the slit of said input diaphragm (6), said slit in said repeller (5) being traversed at its center by said $LaB_6$ body and having a width not substantially less than the width of said carrier (3) and a length not substantially less than the length of said carrier.

2. Apparatus as defined in claim 1, in which said slit of said repeller (5) has a gap extending completely across said repeller so as to divide said repeller (5) into two separate portions.

3. An electron-impact spectrometer comprising an electron-emitting cathode having electrical heating means and constituted, disposed and equipped for focussing emitted electrons on the aperture of an input diaphragm of an electron-energy dispersive means for "monochromatizing" the emitted electron beam with respect to electron-energy, means for shielding said diaphragm and said monochromatizing means from the magnetic field of the current of said electrical heating means of said cathode, an "electron lens" system for focussing said electron beam onto a target and a further lens system for focussing the electrons scattered from said target onto the aperture of an input diaphragm of means for analyzing the energy distribution of the electrons scattered from the target, said spectrometer also having the improvement which consists in that:

said input diaphragm (6) of said monochromatizing means is indirectly heated by said electrical heating means of said cathode, which is supplied with more current than is normally needed for producing the necessary electron emission for said electron-impact spectrometer, thereby increasing the amount of heat radiated away from said cathode device.

4. An electron-impact spectrometer as defined in claim 3, in which said cathode comprises a pointed body of $LaB_6$ (1,2) carried on and heated by a graphite carrier (3) and having its pointed end spaced from said carrier by substantially more than 1 mm and in which said shielding means includes a repeller (5) spaced from said $LaB_6$ body and having a slit running in a direction parallel to the long dimension of said carrier and also parallel to the slit of said input diaphragm (6), said slit in said repeller (5) being traversed at its center by said $LaB_6$ body and having a width not substantially less than the width of said carrier (3) and a length not substantially less than the length of said carrier.

5. An electron-impact spectrometer as defined in claim 4, in which said slit of said repeller (5) has a gap extending completely across said repeller so as to divide said repeller (5) into two separate portions.

* * * * *